US005598942A

United States Patent [19]

Cowie

[11] Patent Number: 5,598,942

[45] Date of Patent: Feb. 4, 1997

[54] WASTE BASKET LINER SYSTEM

[76] Inventor: Ross Cowie, 1069 Borden Side Road, Ottawa, Ontario, Canada, K2C 3P3

[21] Appl. No.: 533,088

[22] Filed: Sep. 25, 1995

[51] Int. Cl.[6] ..... B65F 1/06

[52] U.S. Cl. ..... 220/404; 220/908; 220/410

[58] Field of Search ..... 220/404, 908, 220/403, 62, 408, 410, 400, 402, 720, 666, 651, 654, 466, 470, 468, 461, 86.1; 383/33, 34, 34.1, 104, 119

[56] References Cited

U.S. PATENT DOCUMENTS

| | | | |
|---|---|---|---|
| 1,173,468 | 2/1916 | Trafton | 220/402 |
| 5,014,874 | 5/1991 | Kitsos et al. | 220/908 |
| 5,056,679 | 10/1991 | Lonczak | 220/404 |
| 5,160,063 | 11/1992 | Bailey | 220/404 |
| 5,226,554 | 7/1993 | Dauphinais | 220/402 |
| 5,295,606 | 3/1994 | Karwoski | 220/404 |

FOREIGN PATENT DOCUMENTS

| | | | |
|---|---|---|---|
| 279547 | 8/1988 | European Pat. Off. | 383/33 |
| 215602 | 8/1990 | Japan | 220/908 |
| 2241154 | 8/1991 | United Kingdom | 220/404 |
| 2245151 | 1/1992 | United Kingdom | 220/404 |

*Primary Examiner*—Stephen J. Castellano
*Attorney, Agent, or Firm*—Marks & Clerk

[57] ABSTRACT

A waste disposal bin assembly comprises an outer casing having a sidewall and an open top. A self-supporting insert member conforms to the internal shape of the sidewall and has an upper rim located below a top edge of the sidewall. A disposable bag is inserted in the insert member and has an upper portion folded over the rim of the insert member and tucked between the insert member and an inner surface of the sidewall. In this way, the disposable bag can be neatly retained within the waste disposal bin.

5 Claims, 1 Drawing Sheet

WASTE BASKET LINER SYSTEM

This invention relates to waste disposal bins, and more particularly to a waste disposal bin having an open top of the type commonly used in homes and offices.

To assist in the removal of waste items and to avoid soiling the interior of the bin, it is common practice for people to insert disposable plastic bags into waste disposal bins so that the contents can be easily removed by removing and disposing of the bag. The bags may be commercially available liners intended for this purpose, or, for example, used shopping bags such as plastic grocery bags.

In order to retain the bag in place, it is common practice to fold the lip of the bag over the upper edge of the bin in a convoluted fashion. Often the bin will be designed to have an attractive appearance, for example it may be a wickerwork basket or have a decorated surface, and the untidy effect of the visible bag considerably detracts from the overall appearance of the waste bin. In addition, if heavy items are inserted into the bin, the bag may collapse into the interior of the bin thus allowing waste, particularly liquid waste, for example from coffee cups, to pass between the bin wall and the bag. This can soil the bin, and in the case, for example, of a wicker bin, permanently damage it.

An object of the invention is to alleviate the aforementioned problems.

According to the present invention there is provided a waste disposal bin assembly comprising an outer casing having a sidewall and an open top, a self-supporting insert member conforming to the internal shape of said sidewall and having an upper rim located below a top edge of said sidewall, and a disposable bag inserted in said insert member and having an upper portion folded over said rim of said insert member and tucked between said insert member and an inner surface of said sidewall.

While the invention applies to open top bins, it is of course understood that the bin may have an openable lid, for example it may be a pedal bin.

Preferably the insert member is flexible and resiliently formable so that it can conform to the internal shape of the sidewall. It may be in the form of a flat sheet folded into the shape of the bin.

The bag itself may be an ordinary plastic bag, such as a grocery bag, or alternatively may be a custom design bin liner.

The insert member is preferably made of polyethylene.

The invention will now be described in more detail, by way of example only, with reference to the accompanying drawings, in which.

Figure 1:
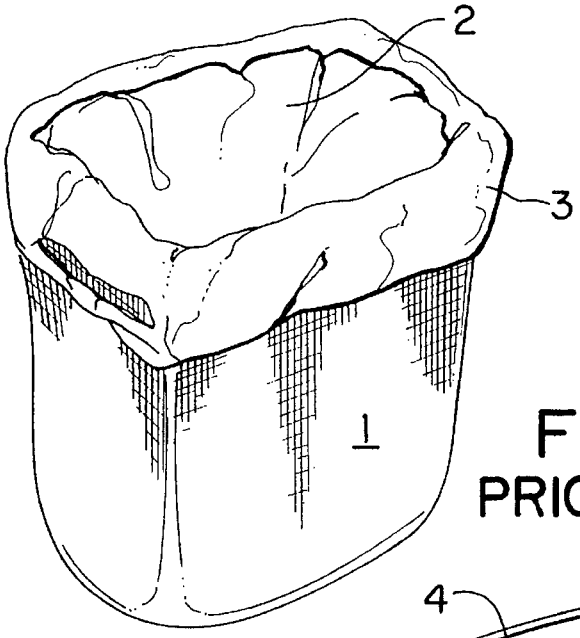
FIG. 1 PRIOR ART
FIG. 1 is a perspective view of a prior art waste bin disposal assembly.

Referring now to FIG. 1, the open topped bin, which is conveniently a wickerwork bin, has inserted therein a plastic grocery bag 2. The upper portion 3 of the grocery bag 2 is folded over a top edge 4 of the bin 1.

Of course, an openable lid (not shown) can be placed over the bin assembly.

As apparent from FIG. 1, this arrangement looks quite ugly and detracts from the appearance of the bin 1, which may have a decorative surface. Also, especially when heavy objects are thrown into the bin there is a tendency for the bag to collapse and the upper portion 3 to slip off the bin 1.

Figure 2:
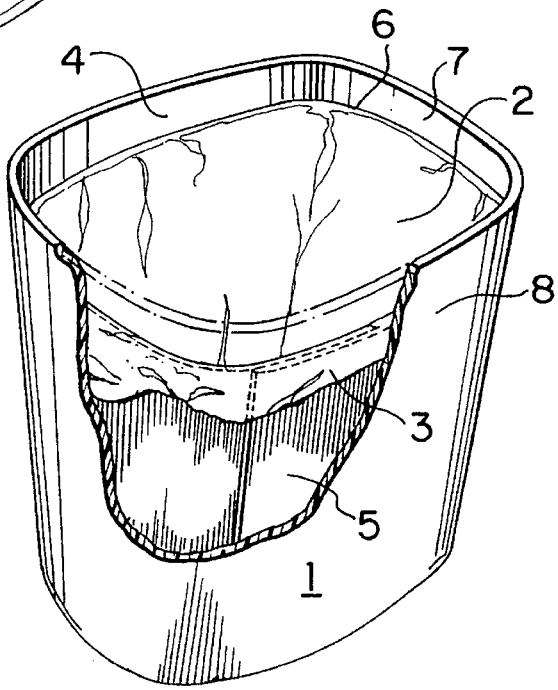
FIG. 2 is a perspective view, partly cut away, of a waste bin disposal assembly in accordance with the invention.
Figure 3:
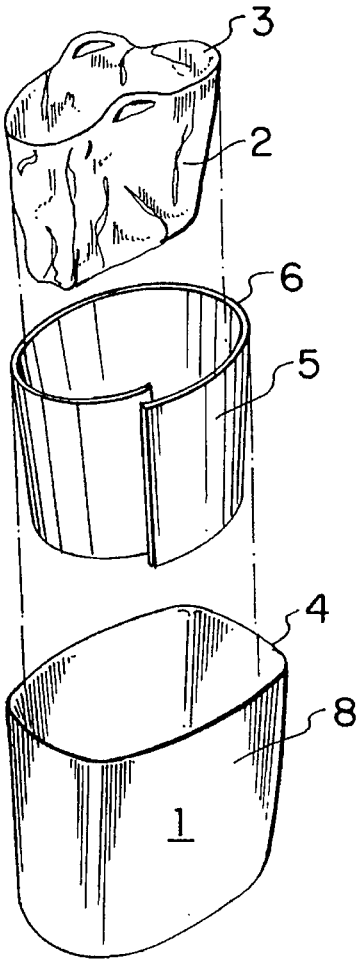
FIG. 3 is an exploded view of the waste bin assembly shown in FIG. 2.

Referring now to FIG. 2, this shows a bin assembly in accordance with the invention. In FIG. 2, an insert member 5 is located inside the bin 1 such that it conforms to the internal shape thereof. The insert member 5, as shown in FIG. 3, is made of a polyethylene sheet folded into the shape of the bin. The sheet 5 is sufficiently stiff to be self-supporting, yet sufficiently deformable to conform to the shape of the bin 1. It also has a slight resilience so that when inserted into the bin 1 it can be manually compressed to a size smaller than the bin 1. Upon release, it expands resiliently outward to conform to the shape of the bin 1.

In FIG. 2 the bag 3, instead of being placed over the bin 1, is placed within the insert 5 such that the upper portion 3 is folded over upper rim 6 of the insert member 5. The convoluted upper portion 3 then becomes tucked between interior surface 7 of bin sidewall 8 and is retained in a neat arrangement trapped between the insert 5 and the interior surface 7 by the resilience of the insert 5.

The upper rim 6 of the insert 5 lies a distance h below the upper edge 4 of the sidewall 8 of the bin 1. The distance h is small relative to the total height of the bin, but sufficiently large to locate the rim 6 neatly below the upper edge 4. Viewed in the plane of the upper edge 4, the bag 2 is therefore not visible.

The bag 2 can be a conventional plastic grocery bag or a custom-made bag designed to fit within the insert 5.

The bin 1 is shown as having a generally rectangular cross-section, although it will be understood to one skilled in the art that the invention applies equally well to bins of circular cross-section or any other cross-section.

Figure 4:
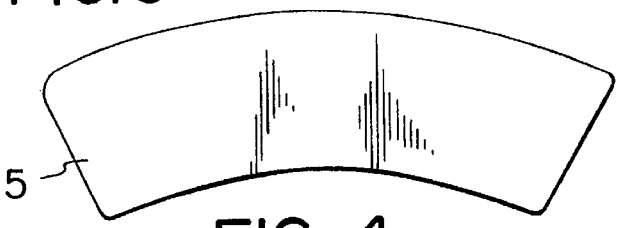
FIG. 4 is a plan view of an insert member.

It will also be noted that the bin 1 has a slight inward taper. In order to ensure that the insert 5 conforms to this taper, the insert 5 is shaped in an arcuate manner as shown in FIG. 4, which is an opened out view of the insert member 5. For a bin with no taper the insert 5 is rectangular in the opened-out view.

In order to use the assembly, the user first takes a plastic bag, which may be a grocery bag or a custom designed bin liner. He then places it within the folded insert 5 (see FIG. 3) and folds the upper portion 3 over the rim 6 of the insert 5. The insert 5 is then manually compressed to a size less than the internal size of the bin 1, and the insert 5 placed within the bin 1. The insert 5 is then released and allowed to deform resiliently so as to conform generally to the shape of the internal surface of the bin 1. It will be understood that the insert 5 does not have to match the internal shape of the bin 1 exactly, but merely sufficiently to retain the bag 2 in a neat and tidy arrangement.

While in the preferred embodiment the insert 1 is in the form of a deformable sheet, it is of course possible to make rigid inserts for specific bins. In this arrangement, a special insert would have to be made for each type of bin available.

It will be seen that the invention overcomes the problems of the prior art in that it neatly and effectively retains the bag in place within the waste bin without detracting from the overall appearance of the latter.

I claim:

1. A waste disposal bin assembly, comprising:

an outer casing having a sidewall and an open top;

a self-supporting insert member conforming to the internal shape of said sidewall and having an upper rim located below a top edge of said sidewall;

a disposable bag inserted in said insert member and having an upper portion folded over said rim of said insert member and tucked between said insert member and an inner surface of said sidewall; and wherein said insert member is flexibly and resiliently deformable to conform to the internal shape of said sidewall, and to spring into contact with said sidewall after being compressed for insertion into said bin.

2. A waste disposal bin assembly as claimed in claim 1, wherein said insert member comprises an open sheet folded into a generally cylindrical form.

3. A waste disposal bin assembly as claimed in claim 2, wherein said sheet is made of polyethylene.

4. A waste disposal bin assembly as claimed in claim 2, wherein said sheet is shaped so that when folded into a generally cylindrical form it has a slight conical shape.

5. A waste disposal bin assembly as claimed in claim 1, wherein said disposable bag is a plastic bag.

* * * * *